US010583949B1

(12) United States Patent
Ellis

(10) Patent No.: US 10,583,949 B1
(45) Date of Patent: Mar. 10, 2020

(54) MACHINE FOR FILLING OIL CARTRIDGES

(71) Applicant: Credence Engineering, Inc., Tempe, AZ (US)

(72) Inventor: James Edward Ellis, Tempe, AZ (US)

(73) Assignee: Credence Engineering, Inc., Tempe, AZ (US)

( * ) Notice: Subject to any disclaimer, the term of this patent is extended or adjusted under 35 U.S.C. 154(b) by 0 days.

(21) Appl. No.: 16/358,572

(22) Filed: Mar. 19, 2019

(51) Int. Cl.
*B65B 63/08* (2006.01)
*B65B 39/12* (2006.01)
*B65B 37/06* (2006.01)
*B65B 3/12* (2006.01)

(52) U.S. Cl.
CPC ..... *B65B 63/08* (2013.01); *B65B 3/12* (2013.01); *B65B 37/06* (2013.01); *B65B 39/12* (2013.01)

(58) Field of Classification Search
CPC ..... B65B 63/08; B65B 3/12; B65B 39/12; B65B 37/06
See application file for complete search history.

(56) References Cited

U.S. PATENT DOCUMENTS 5,479,968 A * 1/1996 Sanchez ..... B41J 2/17506 141/110
6,214,117 B1 * 4/2001 Prentice ..... B23K 3/0607 118/669
7,418,981 B2 * 9/2008 Baker ..... A61J 1/2089 141/104
7,954,521 B2 * 6/2011 Py ..... B65D 51/002 141/329
7,980,276 B2 * 7/2011 Py ..... B29C 66/1312 141/11
8,667,996 B2 * 3/2014 Gonnelli ..... A61J 1/2089 141/322
8,807,177 B2 * 8/2014 Strangis ..... B63C 9/0005 141/9
9,139,316 B2 * 9/2015 Husnu ..... B65B 3/003
9,475,597 B2 * 10/2016 Py ..... B65B 3/003
10,279,934 B2 * 5/2019 Christensen ..... B65B 3/003
2006/0266431 A1 * 11/2006 Thilly ..... A61M 5/162 141/329
2007/0121169 A1 5/2007 Inukai
2017/0030342 A1 * 2/2017 Brown ..... F04B 15/08
2017/0121169 A1 * 5/2017 Dailey ..... A24F 47/002
(Continued)

OTHER PUBLICATIONS

Cite No. NP1 YouTube Video Published Oct. 2, 2017 "Marijuana Oil Cartridge Filling Machine" https://www.youtube.com/watch?v=gbegkscwzmY.

(Continued)

*Primary Examiner* — Nicolas A Arnett
(74) *Attorney, Agent, or Firm* — Royse Law Firm, PC

(57) ABSTRACT

A machine for filling cannabis oil or other fluids into dispensing cartridges includes a fluid reservoir, a fluid pump, and an injection needle. The fluid pump may be disposed directly below the fluid reservoir, and the injection needle may be disposed directly below the fluid pump. A lift mechanism raises and lowers a movable cartridge holder to move a dispensing cartridge toward and away from the injection needle. A heater may be formed about the needle to heat fluid therein. Heaters may also be provided for heating the fluid reservoir and the fluid pump.

18 Claims, 8 Drawing Sheets

(56) References Cited

U.S. PATENT DOCUMENTS

2017/0233114 A1* 8/2017 Christensen ..... B65B 3/003
141/2

OTHER PUBLICATIONS

Cite No. NP2 YouTube Video Published Oct. 2, 2017 "Credence Filler" https://www.youtube.com/watch?v=7YaFyhclTkl.
Cite No. NP3 YouTube Video Published Sep. 23, 2017 "Credence Filler" https://www.youtube.com/watch?v=S8UuOfddYKw&t=73s.
Cite No. NP4 YouTube Video Published Oct. 2, 2017 "Credence Filler" https://www.youtube.com/watch?v=PeC0Se7LBK0.
Cite No. NP5 YouTube Video Published Sep. 23, 2017 "Credence Filler" https://www.youtube.com/watch?v=kd29K0cFS1l.

* cited by examiner

FIG. 4
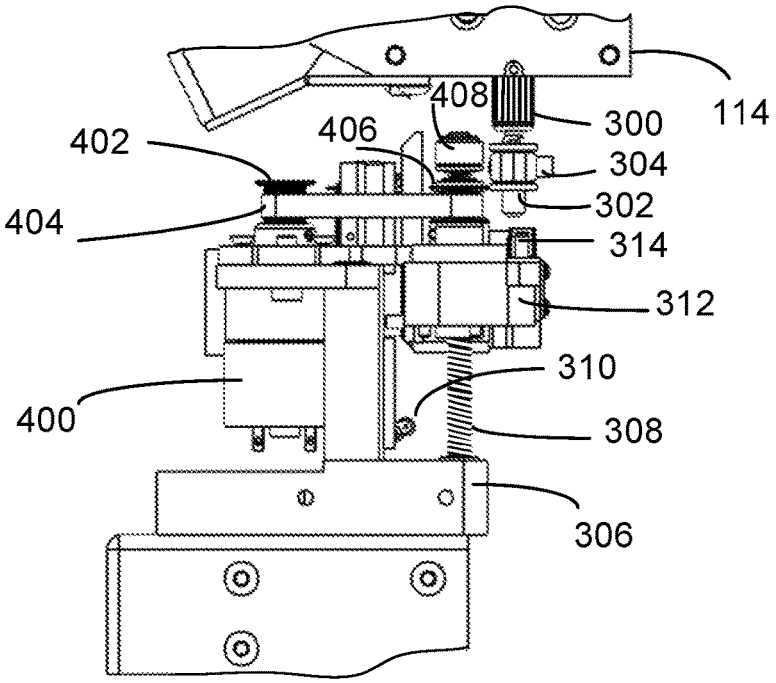
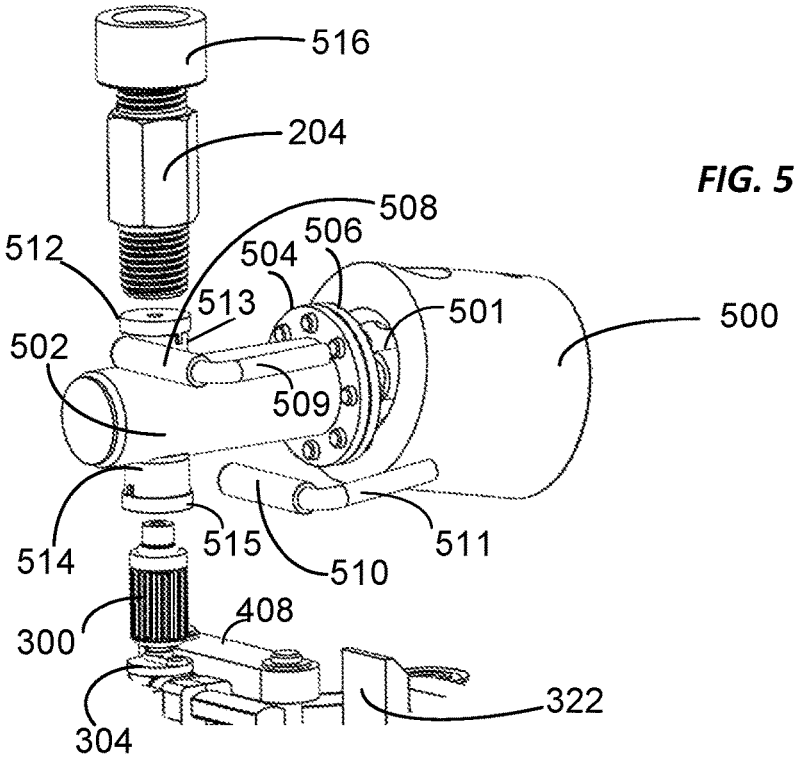
FIG. 5

MACHINE FOR FILLING OIL CARTRIDGES

BACKGROUND OF THE INVENTION

Field of the Invention

The present invention relates generally to machines for filling cartridges with oil-based fluids, and more particularly to an improved machine for filling cartridges with cannabis oil.

Description of the Relevant Art

Electronic cigarettes, or e-cigarettes, have become popular in recent years for smokers who wish to avoid inhaling toxic byproducts of burning tobacco and the outer paper liner. These devices are typically battery-operated, and are used by people to inhale vapors that typically contain nicotine. Such devices are also known as "vapes" or "vape pens". A liquid solution containing nicotine, and possibly other ingredients, is packaged in a cartridge having a heater to atomize the liquid. The battery powers the heating element to vaporize the liquid as the user inhales.

The same principles of "vaping" have been applied to smoking of marijuana. Tetrahydrocannabinol, or "THC", is the main psychoactive compound contained in the cannabis plant that gives a sensation of being "high". THC can be consumed by smoking marijuana, but it is also available as cannabis oil, or "marijuana oil". Such oils are typically produced by extracting such oils from the cannabis plant using a solvent, and then refining the extracted composition, as by filtration and distillation or the like. This cannabis oil can then be vaporized in a heated cartridge, and inhaled, in a manner similar to that used for e-cigarettes.

Cannabis oil is relatively thick and viscous, and it presents problems that are not faced by producers of e-cigarette cartridges. For example, because cannabis oil is so thick, it tends to easily coagulate. Machines used in the past to fill vaping cartridges with cannabis oil frequently clog. In those instances, the machine must be stopped to clean and clear the clog before cartridge filling can be resumed. This problem is further increased since the open end, or filling port, of the cartridge used to receive such oil is relatively small in size, and a needle is therefore used to inject such oil into such port. The need to inject such thick oil through a relatively slender needle can make it even more difficult to keep the oil flowing.

Cannabis oil filling machines typically include a storage reservoir for storing a quantity of cannabis oil and a pump for pumping a controlled amount of cannabis oil into each cartridge during each filling cycle. As already mentioned, cannabis oil tends to be thick and coagulates relatively easily. If the filling process is halted temporarily, for example, to replace the filling needle, cannabis oil can form a clog in the line between the storage reservoir and the pump, or between the pump and the injection needle. Likewise, if the operator needs to leave the filling machine unattended for a period of time, oil tends to coagulate within, and clog, the inner bore of the filling needle; when this happens, the operator must change filling needles, which only increases costly downtime.

SUMMARY OF THE INVENTION

Accordingly, it is an object of the present invention to provide a filling machine for efficiently and accurately injecting an oil-based fluid into dispensing cartridges while minimizing the likelihood of the oil-based fluid coagulating and requiring the filling machine to be stopped for maintenance.

It is further object of the present invention to provide such a filling machine which is adapted to inject such oil-based fluid through a needle while minimizing the likelihood of the oil-based fluid clogging within the needle.

It is still a further object of the present invention to provide such a filling machine for rapidly injecting an oil-based fluid into dispensing cartridges while minimizing the likelihood of the oil-based fluid forming a clog between a supply reservoir and a dispensing pump.

Still another object of the present invention is to provide such a filling machine which minimizes the likelihood of the oil-based fluid forming a clog between the dispensing pump and an injection needle used to inject pumped oil-based fluid into a dispensing cartridge.

A further object of the present invention is to provide such a filling machine which minimizes the likelihood of the oil-based fluid forming a clog, while minimizing the number of heaters used to heat such oil-based fluid.

It is also an object of the present invention to provide such a filling machine which is of relatively simple, compact, and inexpensive construction, and which may be used to fill a large quantity of dispensing cartridges in a relatively small amount of time.

Another object of the invention is to provide such a filling machine wherein most of the operations performed by such machine are automated.

Briefly described, and in accordance with various embodiments thereof, the present invention provides apparatus for injecting a fluid into a dispensing cartridge, and including a needle having a shaft extending between a first end adapted to receive fluid and an opposing second end adapted to dispense fluid. A reservoir adapted to store the fluid is coupled to the inlet of a fluid pump. The fluid pump has an outlet adapted to selectively force fluid therefrom, and the pump outlet is coupled to the first end of the needle. A movable cartridge holder is provided for releasably holding a dispensing cartridge to be filled. The cartridge holder is configured to alternately move a dispensing cartridge toward the second end of the needle for filling, and for moving the dispensing cartridge away from the second end of the needle after filling. A needle heater is disposed in proximity to the shaft of the needle; the needle heater is adapted to heat fluid within the needle for preventing such fluid from coagulating within the needle.

In various embodiments of the invention, the needle heater includes a generally cylindrical bobbin extending around the shaft of the needle, and resistive wire is coiled about the bobbin for generating heat when an electrical current is conducted thereby. In some of these embodiments, the resistive wire is nichrome wire.

In various embodiments, a drive motor is coupled to the movable cartridge holder. The drive motor alternately moves the movable cartridge holder, and a dispensing cartridge supported thereby, toward and away from the second end of the needle as each dispensing cartridge is filled.

In various embodiments, the fluid pump includes a pump motor. The pump motor is actuated when the drive motor has moved the movable cartridge holder, and a dispensing cartridge supported thereby, proximate the second end of the needle. In some of these embodiments, a control circuit is coupled to the drive motor and to the fluid pump for synchronizing the actuation of the pump motor with the operation of the drive motor.

In various embodiments of the present invention, the fluid pump includes a pump heater adapted to heat fluid within the fluid pump.

In some embodiments of the invention, the fluid storage reservoir includes a reservoir heater for heating fluid within the reservoir.

In various embodiments of the invention, the fluid stored by the reservoir, and injected through the needle, is cannabis oil.

In various embodiments of the present invention, an apparatus for injecting a fluid, for example, cannabis oil, into a dispensing cartridge includes a reservoir adapted to store the fluid. The reservoir has an upper end for receiving fluid to be stored and a lower end for delivering fluid stored thereby. A fluid pump is disposed below, and closely proximate to, the lower end of the reservoir; the pump includes an inlet coupled to the lower end of the reservoir for receiving fluid therefrom. The pump also includes an outlet adapted to selectively force fluid therefrom. A needle has a shaft extending between an inlet end adapted to receive fluid and an opposing outlet end adapted to dispense fluid. The inlet end of the needle communicates with the outlet of the fluid pump for receiving fluid therefrom. In some embodiments, the needle is disposed generally below the fluid pump, and the inlet end of the needle is closely proximate to the outlet of the fluid pump. A movable cartridge holder is adapted to releasably hold a dispensing cartridge to be filled. The cartridge holder is configured to alternately raise a dispensing cartridge toward the outlet end of the needle for filling, and to lower the dispensing cartridge away from the outlet end of the needle for unloading.

In some embodiments of such invention, the fluid pump includes a pump heater adapted to heat fluid within the fluid pump. Also in some embodiments of such invention, the fluid reservoir includes a reservoir heater for heating fluid within the reservoir. In some embodiments of such invention, a needle heater is disposed proximate the shaft of the needle and adapted to heat fluid therein for preventing such fluid from coagulating within the needle. Also, in some of such embodiments, a drive motor is coupled to the movable cartridge holder alternately raising the movable cartridge holder toward the outlet end of the needle, and lowering the movable cartridge holder away from the outlet end of the needle. The fluid pump includes a pump motor that is actuated when the movable cartridge holder has raised a dispensing cartridge proximate the outlet end of the needle; in some embodiments of such invention, a control circuit coupled to the drive motor and to the fluid pump synchronizes the actuation of the pump motor with the operation of the drive motor.

In some embodiments of such invention, the fluid pump includes a pump heater adapted to heat fluid within the fluid pump. Also, in some embodiments of such invention, the fluid reservoir includes a reservoir heater for heating the fluid within the reservoir.

In various embodiments of the present invention, an apparatus for injecting a fluid into a dispensing cartridge includes a reservoir adapted to store a fluid; the reservoir includes an outlet for delivering stored fluid. A fluid pump has an inlet coupled to the outlet of the reservoir for receiving fluid therefrom; the fluid pump also includes an outlet adapted to selectively force fluid therefrom. A needle has a shaft extending between an inlet end adapted to receive fluid and an opposing outlet end adapted to dispense fluid. The needle is disposed generally below the fluid pump, with the inlet end of the needle coupled closely proximate to the outlet of the fluid pump for receiving fluid therefrom. A movable cartridge holder is adapted to releasably hold a dispensing cartridge to be filled. The cartridge holder can alternately raise a dispensing cartridge toward the outlet end of the needle and lower the dispensing cartridge away from the outlet end of the needle. In some embodiments of such invention, a needle heater is disposed proximate the shaft of the needle for heating fluid therein to prevent coagulation of the fluid within the needle.

BRIEF DESCRIPTION OF THE DRAWINGS

FIG. 4 is a partial side view of the filling machine showing a drive motor for raising and lowering the movable cartridge holder.

FIG. 5 is a partial perspective view of a fluid pump used to pump fluid from the fluid reservoir to the heated needle.

DETAILED DESCRIPTION

Figure 1:
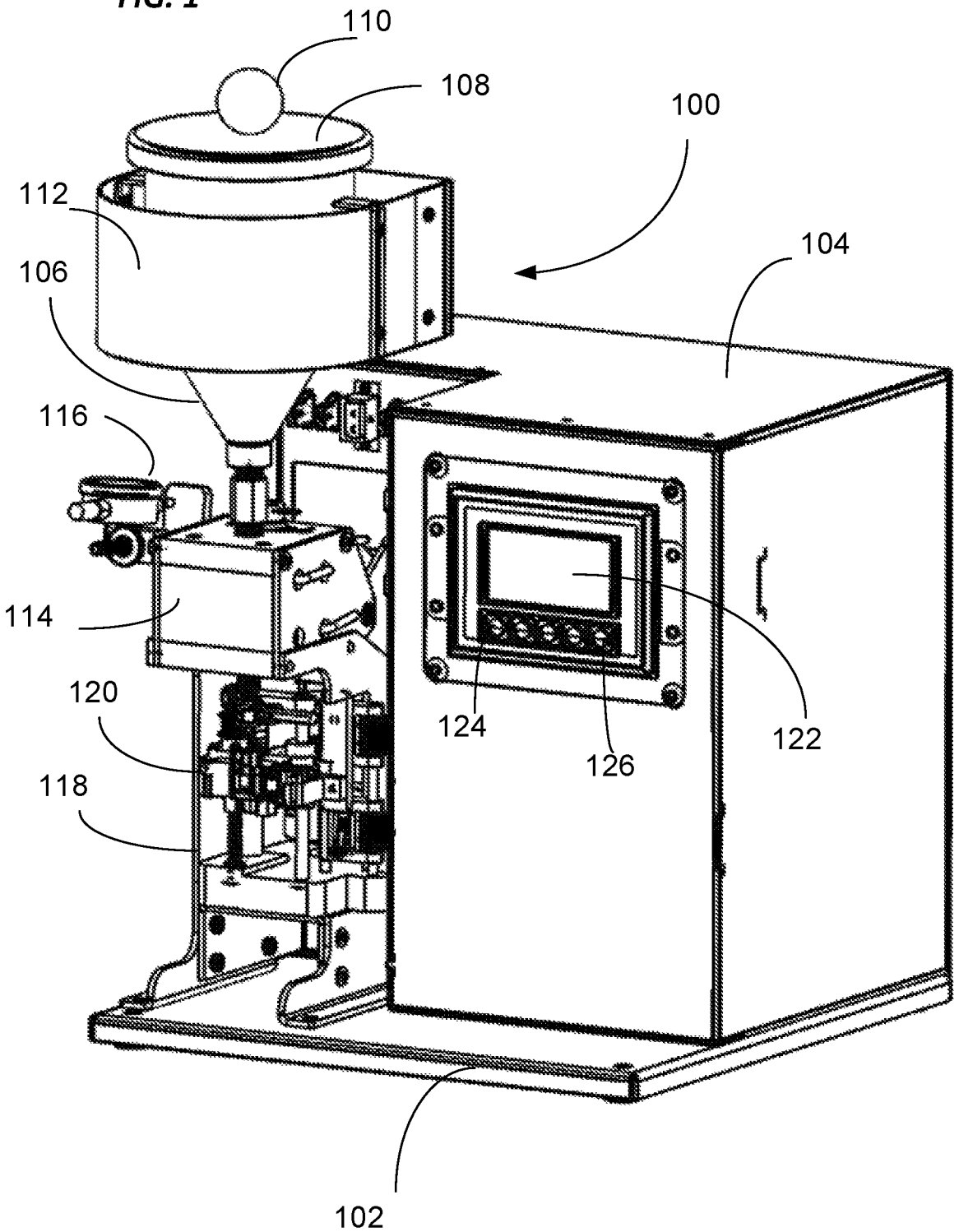
FIG. 1 is a perspective view of a fluid dispensing cartridge filling machine in accordance with one embodiment of the present invention.

FIG. 1 illustrates a fluid dispensing cartridge filling machine 100 in accordance with a first embodiment of the present invention. Machine 100 may be used to inject a fluid, for example, cannabis oil or another high viscosity oil, into a dispensing cartridge. These dispensing cartridges may be of the type supplied by Jupiter Research, LLC of Scottsdale, Ariz. under the designation "L6-Glass"; such dispensing cartridges are also known as "e-cartridges" and may be used to smoke vaporized cannabis oil where permitted by law. A typical dispensing cartridge holds one-half gram of oil-based composition when filled.

Filling machine 100 includes a base 102 supporting a cabinet 104. A fluid reservoir 106, shown in the form of a hopper, is supported from cabinet 104 at an elevated position for storing fluid to be injected into dispensing cartridges. Reservoir 106 has an upper end for receiving fluid to be stored, and an opposing lower end for delivering stored fluid. Reservoir 106 is covered by a lid 108 including a knob 110 for raising lid 108 when fluid is to be added to reservoir 106. A heat shield 112 encircles reservoir 106 to protect users from a heater element (not shown in FIG. 1) used to heat fluid therein.

The lower portion of reservoir 106 is coupled to fill pump head assembly 114 for supplying fluid thereto. A dial indicator 116 is provided on fill pump head 114 to indicate the relative flow rate of the fluid being pumped. Fill pump head assembly is supported in part by pump side support 118. Movable cartridge holder 120 is adapted to releasably hold a dispensing cartridge, and is movably supported within pump side support 118 for selectively raising and lowering a fluid dispensing cartridge to be filled. An alphanumeric display panel 122 is provided on the front of cabinet 104 to display control settings to a user. A series of pushbuttons, including those referenced 124 and 126, are provided below display panel for allowing a user to program desired settings into the filling machine.

Figure 2:
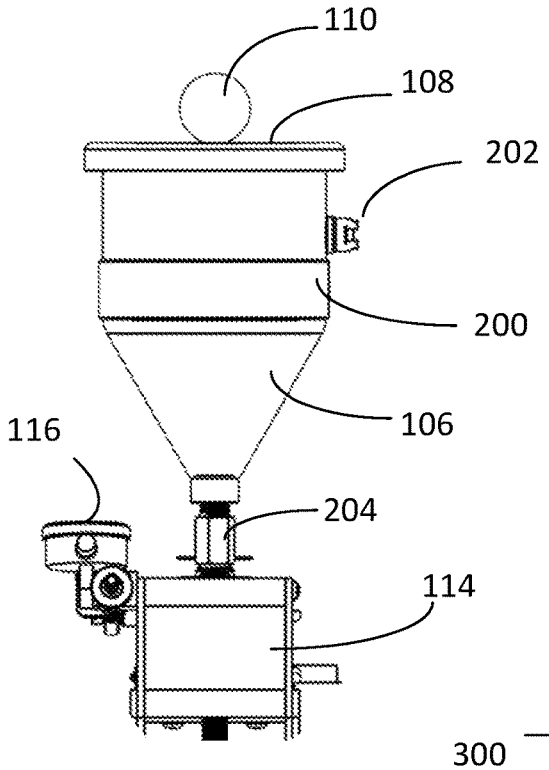
FIG. 2 is a partial front view of the fluid reservoir shown in FIG. 1 with the heat shield removed for better clarity.

FIG. 2 shows fluid reservoir 106 (see FIG. 1) with heat shield 112 removed. The lower end of reservoir 106 is coupled to fill pump head 114 by pipe fitting 204 to supply stored fluid to a fluid pump. Reservoir 106 may have a capacity of one liter, and may be a seamless stainless steel hopper of the type produced by Toledo Metal Spinning Company of Toledo, Ohio under Part No. TMS4316. Because reservoir 106 is positioned directly above fill pump head 114, stored fluid can drain from the bottom of reservoir 106 directly into the inlet of the fluid pump by gravity feed, eliminating the need for any air pressure assist.

Reservoir 106 is surrounded by reservoir heater 200 for heating fluid reservoir 106. Reservoir heater 200 may be a flexible band heater of the type produced by Tempco Electric Heater Corporation of Wood Dale, Ill., and supplied by McMaster-Carr of Santa Fe Springs, Calif. under Part No. 3671K131. Heater 200 may operate at 120 volts AC and provide up to 400 Watts of power. Thermal sensor 202 is mounted to reservoir 106 to sense the temperature of the fluid stored therein. Thermal sensor 202 may be a thermocouple, and may be electrically coupled to an electronic control circuit (not shown in FIG. 2) for controlling the flow of current through heater 200 to maintain a desired temperature. Alternatively, thermal sensor 202 may simply be an over-temp switch, also known as a high-limit thermostatic switch, similar to those sold under Model No. 48-1024, for selectively opening or closing a circuit path, depending upon whether the fluid temperature is below or above a desired temperature. In the case of cannabis oil, the temperature of the fluid within reservoir 106 is preferably maintained within the range of 50-80 degrees Centigrade.

Figure 3:
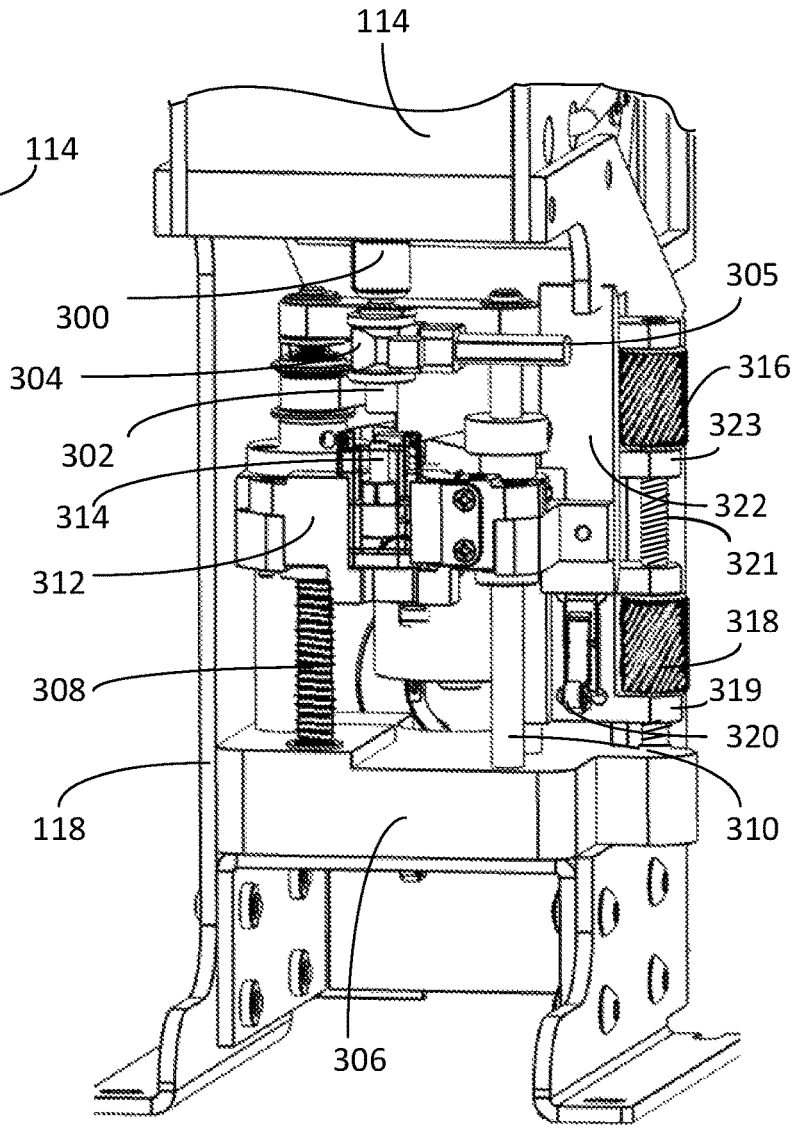
FIG. 3 is a partial perspective view of the lower portion of the filling machine showing details of the movable cartridge holder used to move a dispensing cartridge toward and away from the lower end of a heated needle.

Turning now to FIG. 3, the components for injecting fluid into a dispensing cartridge are shown in greater detail. Extending downwardly from the bottom of fill pump head 114 is a luer lock connector 300 for releasably securing injection needle 302 thereto. Injection needle 302 may be, for example, a 17 gauge 304 stainless steel, metal-hub, blunt-point needle of the type available from Hamilton Company of Reno, Nev. as Part No. 7748-03. Needle 302 has a shaft extending between first and second opposing ends. The first end of the needle shaft is releasably secured to luer connector 300 for receiving pressurized fluid, and the second, lower end of needle 302 is selectively disposed into an open end of a dispensing cartridge to dispense fluid into the dispensing cartridge. In some cases, it may be desirable to flatten the lower end of the needle, from a circular shape to a more oval shape, to more easily access the open end of the dispensing cartridge.

Needle heater 304 is disposed proximate the shaft of needle 302; as shown in FIG. 3, needle heater 304 may encircle the shaft of needle 302. Needle heater 304 is adapted to heat needle 302, including fluid present in the central bore of needle 302, to preventing such fluid from clogging or coagulating within the needle. Needle heater 304 may include a generally cylindrical bobbin having upper and lower flanges and a central apertured core for allowing the shaft of needle 302 to pass therethrough, whereby the bobbin extends around the shaft of needle 302. Resistive wire, e.g., nichrome wire having Polyimide enamel insulation of the type commercially available from California Fine Wire Co. of Grover Beach, Calif., is coiled about the bobbin, and the electrical leads of such coiled wire extend out through heater pigtail 305 for coupling to a source of electrical current. Passing electrical current through such resistive wire creates heat around the shaft of needle. It has been found that coiling 20 feet of 0.005 inch nichrome wire about a supporting bobbin produces sufficient heat to maintain needle 302 within the range of 50-80 degrees Centigrade. If desired, a thermocouple (not shown) may be secured to the bobbin of needle heater 304 for sensing the temperature proximate needle 302, and the electrical output of such thermocouple may be provided to a control circuit for adjusting the amount of current passed through such nichrome wire to maintain a desired temperature. It has been found, however, that applying a continuous voltage across a 20-foot length of coiled nichrome wire, needle heater 304 may be left on continuously with good results.

Still referring to FIG. 3, a mounting plate 306 is supported by pump side support 118 above base 102. Mounting plate 306 rotatably supports a carriage lift screw 308, and fixedly supports a guide shaft 310. Movable cartridge holder 312 threadedly engages carriage lift screw 308, and slidingly engages guide shaft 310, for moving upwardly or downwardly, depending upon the direction of rotation of carriage lift screw 308. Dispensing cartridge 314 is releasably engaged with movable cartridge holder 312 for upward and downward travel therewith. In this manner, carriage lift screw 308 is adapted to move the open upper end of dispensing cartridge 314 upwardly proximate to the lower end of needle 302 for filling, and to thereafter move dispensing cartridge 314 back down away from needle 302 for removal, and replacement by a fresh empty dispensing cartridge.

Still referring to FIG. 3, an upper limit adjustment knob 316, and a lower limit adjustment knob 318, are provided to adjust the extent of upward and downward travel of cartridge holder 312. Lower adjustment knob 318 is secured to a bracket 319 which can move vertically along threaded guide rod 321; adjustment knob 318 is internally threaded to threadedly engage guide rod 321. Adjustment knob 318 may be rotated to adjust the height of bracket 319. A first microswitch 320 is mounted on bracket 319 for limiting downward travel of cartridge holder 312. First microswitch 320 can be raised or lowered by rotating adjustment knob 318. A switch actuator 322 travels along with cartridge holder 312, and when its lower end engages the roller wheel of microswitch 320, downward travel of cartridge holder 312 ceases. Upper limit adjustment knob 316 is engaged with a similar movable bracket 323, and is also threadedly engaged with threaded guide rod 321 for adjusting the height of a second, similar microswitch (not visible) secured to bracket 323. When the upper end of switch actuator 322 engages the wheel of this second microswitch, upward travel of cartridge holder 312 ceases. Though not visible in FIG. 3, each of brackets 319 and 323 may also slidingly engage a second, smooth guide rod to maintain a fixed lateral orientation.

As shown in FIG. 4, electric motor 400 is used to selectively raise and lower cartridge holder 312. Electric motor 400 is preferably a 12 volt DC electric, high torque gear box motor of the general type sold under the trademark "CMDF" and operating in the range of 500-1,000 RPM. While this motor is rated for operation at 12 volts DC, applicant has found that running such motor at 24 volts DC provides improved performance while maintaining a highly compact design; motors designed for 24 volt DC operation are typically much larger. Applicant has found that running such a 12 volt DC electric, high torque gear box motor at 24 volts DC does not curtail the life of such motor because the motor is being operated at such a low duty cycle. The driveshaft of stepper motor 400 is coupled with belt drive pulley 402. Drive belt 404 engages belt drive pulley 402 and also engages pulley 406. Pulley 406 is secured to screw shaft 308 and rotates therewith. The upper end of screw shaft 308 is rotatably supported from an upper bearing housed in support bridge 408. Thus, as drive belt 404 rotates, pulley 406 and screw shaft 308 rotate with it. Cartridge holder 312 includes an internally threaded collar, and screw shaft 308 passes upwardly through the internally threaded collar of cartridge holder 312. As screw shaft 308 rotates in a first direction, the threads of screw shaft 308 force the threaded collar of cartridge holder 312 upward, and as screw shaft 308 rotates in the opposite direction, the threads of screw shaft 308 force the threaded collar of cartridge holder 312 downward. When screw shaft 308 is at rest, cartridge holder 312 remains in a fixed position. The lower end of screw shaft 308 rotates freely in a bearing supported by mounting plate 306. Accordingly, stepper motor 400 serves as a drive motor, and is coupled to movable cartridge holder 312 by drive belt 404 and screw shaft 308 to alternately move cartridge holder 312 toward and away from the lower end of injection needle 302.

Referring now to FIG. 5, the fluid pump used to pump fluid from reservoir 106 is shown in greater detail, with surrounding components removed for greater clarity. Pipe fitting 204 includes a threaded upper end that is coupled to the lower end of reservoir 106 by coupler 516. The threaded lower end of pipe fitting 204 engages a threaded hole in an upper pump plate (not shown in FIG. 5) and engages an apertured seal disc 512 which, in turn, rests upon a Teflon port seal 513 that engages the upper inlet port of ceramic sleeve 502 of the pump assembly. This upper inlet port of ceramic sleeve 502 thereby serves as a pump inlet coupled to reservoir 106 and is adapted to receive fluid therefrom. The lower outlet port of ceramic sleeve 502 is coupled with a lower Teflon port seal 514, and a similar lower apertured seal disc 515 is provided at the bottom of Teflon port seal 514. Teflon port seal 514 and lower seal disc 515 are inserted within a mating hole formed in a lower pump plate (not shown in FIG. 5). Fluid discharged from ceramic sleeve 502 is forced out through Teflon port seal 514 and lower seal disc 515 into luer connector 300 for passage into injection needle 302. Accordingly, the lower outlet from ceramic sleeve 502 serves as a fluid pump outlet adapted to selectively force fluid therefrom, and into the upper end of injection needle 302.

The rearmost end of ceramic sleeve 502 terminates in a radial seal 504 which is secured by fasteners to mating radial flange 506 of pump head housing 114.

Pump heater cartridges 508 and 510 are disposed above and below ceramic sleeve 502, respectively, for heating ceramic sleeve 502 and fluid contained therein. Each of heater cartridges 508 and 510 may supply up to 100 Watts of heat. Electrical wires 509 and 511 extend from heater cartridges 508 and 510, respectively, for selectively supplying electrical current thereto. As will be explained herein, a thermal sensitive switch, or thermocouple, may be provided on the fluid pump housing to control the flow of electrical current to heater cartridges 508 and 510 to maintain a desired temperature.

Because the fluid pump components are disposed directly below the lower end of reservoir 106, and because both reservoir 106 and ceramic sleeve 502 of the pump are heated, the fluid being pumped is not as likely to coagulate or clot. Moreover, because needle 302 is disposed generally directly below the fluid pump, and because needle 302 is also heated, the pumped fluid is less likely to coagulate or clot within either the pump outlet or within the needle.

Ceramic sleeve 502 is coupled with a piston 501 that is housed within a pump rotator drum 500. Pump rotator drum 500, piston 501 and ceramic sleeve 502 may be components of a valveless, true volumetric metering pump of the type commercially available from Fluid Metering, Inc. of Syosset, N.Y., for example, Model No. Model Q-CSC-WT. This type of metering pump uses a piston rod having a flat formed on one end, and piston rod 501 rotates within ceramic sleeve 502. The cylindrical wall of piston 501 seals off the upper (inlet) and lower (outlet) ports of ceramic sleeve 502, except when the flat of the piston rod is aligned with each of such ports. As piston 501 rotates, it is also reciprocated within ceramic sleeve 502. A fluid chamber is formed between the end of piston 501 and the sealed end of ceramic sleeve 502. Piston 501 moves away from the sealed end of ceramic sleeve 502 as the flat of piston 501 aligns with the upper (inlet) port to suction fluid in, and piston 501 moves toward the sealed end of ceramic sleeve 502 as the flat of piston 501 rotates over to the lower (outlet) port for pumping fluid out. The length of the reciprocation stroke can be changed to adjust the flow rate of the pump; as the reciprocation stroke increases, the flow rate increases proportionally. The piston drive mechanism housed within pump rotator drum 500 is configured allow variation in the angle between the longitudinal axis of ceramic sleeve 502 and the longitudinal axis of pump rotator drum 500. When this angle is at a minimum, i.e., the two axes are co-linear, the length of the reciprocation stroke is close to zero, resulting in minimal flow. As this angle is increased, the reciprocation stroke lengthens and the flow rate increases.

Figure 6:
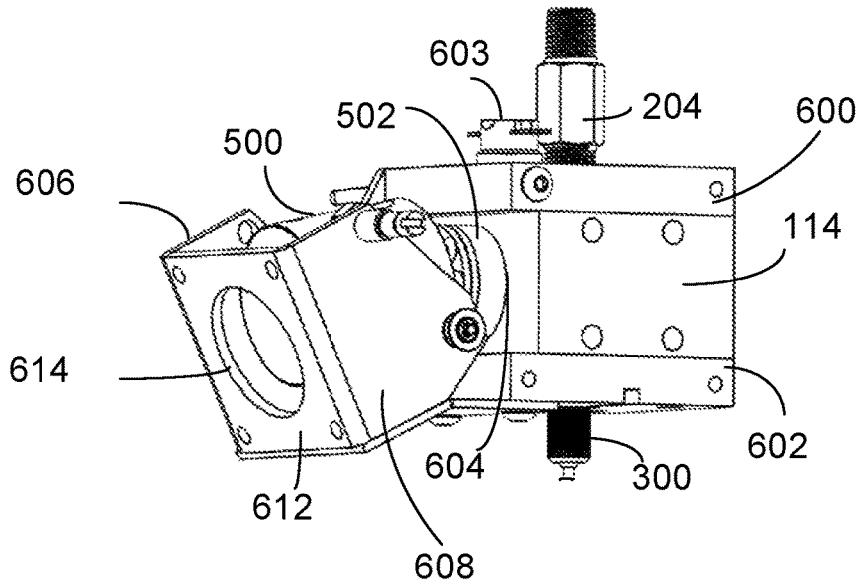
FIG. 6 is a partial perspective rear view of a housing supporting the fluid pump shown in FIG. 5.
Figure 7:
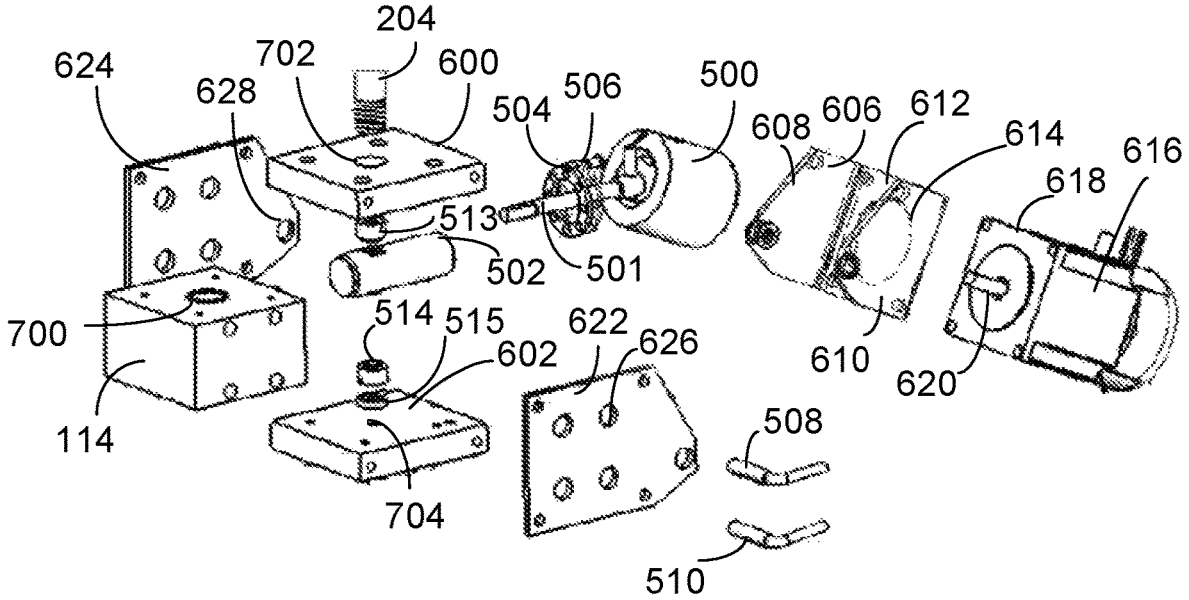
FIG. 7 is an exploded view of the fluid pump and its associated pump motor.

Turning now to FIGS. 6 and 7, pump head housing 114 is shown in greater detail. Pump head housing 114 is joined to an upper plate 600 and a lower plate 602. Also visible within FIG. 6 is a thermal sensor 603; thermal sensor 603 may be a thermocouple for providing temperature information to a temperature control circuit (not shown), if desired, for varying the flow of current through pump heater cartridges 508 and 510 (see FIG. 5) in a manner that maintains pump head housing at a desired elevated temperature to aid in preventing fluid pumped thereby from coagulating or clotting. Alternatively, thermal sensor 603 may simply be a high-limit temperature switch, e.g., the thermal switch available as the Uxcell Model KSD301 temperature control switch, having electrical contacts that are normally open, but which close when the temperature reaches approximately 40 degrees Centigrade.

Pump head housing 114 has a horizontal lateral bore 604 formed therein for receiving ceramic sleeve 502. An upper vertical bore 700 extends from the top of pump head housing 114 and intersects lateral bore 604 that houses ceramic sleeve 502 for delivering fluid thereto. Upper vertical bore 700 receives seal disc 512 and Teflon port seal 513 to sealingly couple the inlet port of ceramic sleeve 502 to upper mounting plate 600. A corresponding lower vertical bore (not shown) extends from the bottom of pump head housing 114 and intersects lateral bore 604 that houses ceramic sleeve 502 for discharging fluid pressurized by the pump; seal disc 515 and Teflon port seal 514 are received within such lower vertical bore of pump head housing 114 to sealingly couple the outlet port of ceramic sleeve 502 to lower mounting plate 602. A bore 702 is formed in upper plate 600 that is vertically aligned with bore 700 in pump head housing 114 for directing fluid thereto; a corresponding bore 704 is formed in lower plate 602 for passing outgoing fluid discharged from ceramic sleeve 502. By supporting ceramic sleeve 502 within pump head housing 114, by fastening upper mounting plate 600 and lower mounting plate 602 thereto, and by using Viton-brand synthetic rubber/fluoropolymer elastomer seals at the juncture of such components, an effective and reliable seal is maintained, even at relatively high pressures.

As shown in FIGS. 6 and 7, motor pivot plate 606 is provided for supporting pump rotator drum 500. Motor pivot plate 606 includes opposing side walls 608 and 610 and a rear wall 612 having a circular hole 614 formed therein. Electric pump motor 616 is provided to power pump rotator drum 500. Pump motor 616 is preferably a high-torque, 2-phase hybrid, double-shaft electric stepper motor of the type commercially available from Applied Motion Products, Inc. of Watsonville, Calif. under Model No. HT23-598D. Pump motor 616 includes a base plate 618 for being fastened to rear wall 612 of motor pivot plate 606. Drive shaft 620 of pump motor 616 extends through circular hole 614 for driving pump rotator drum 500. As will be explained in greater detail below, a control circuit is electrically coupled to drive motor 400 and to pump motor 616 for synchronizing the actuation of the pump motor 616 with the operation of drive motor 400; pump motor 616 is actuated when drive motor 400 has moved cartridge holder 312, and dispensing cartridge 314, proximate to the second end of needle 302.

As mentioned above, adjustment of the angle between pump rotator drum 500 and ceramic sleeve 502 is used to adjust the length of the piston reciprocation stroke, and hence, the fluid flow rate. Referring to FIG. 7, a pair of opposing side plates 622 and 624 are fastened to opposing sides of pump head housing 114. Side plates 622 and 624 include pivot mount holes 626 and 628 respectively to pivotally support motor pivot plate 606, thereby allowing adjustment of the angle formed between ceramic sleeve 502, on one hand, and pump rotator drum 500, motor pivot plate 606, and pump motor 616, on the other hand.

Figure 8:
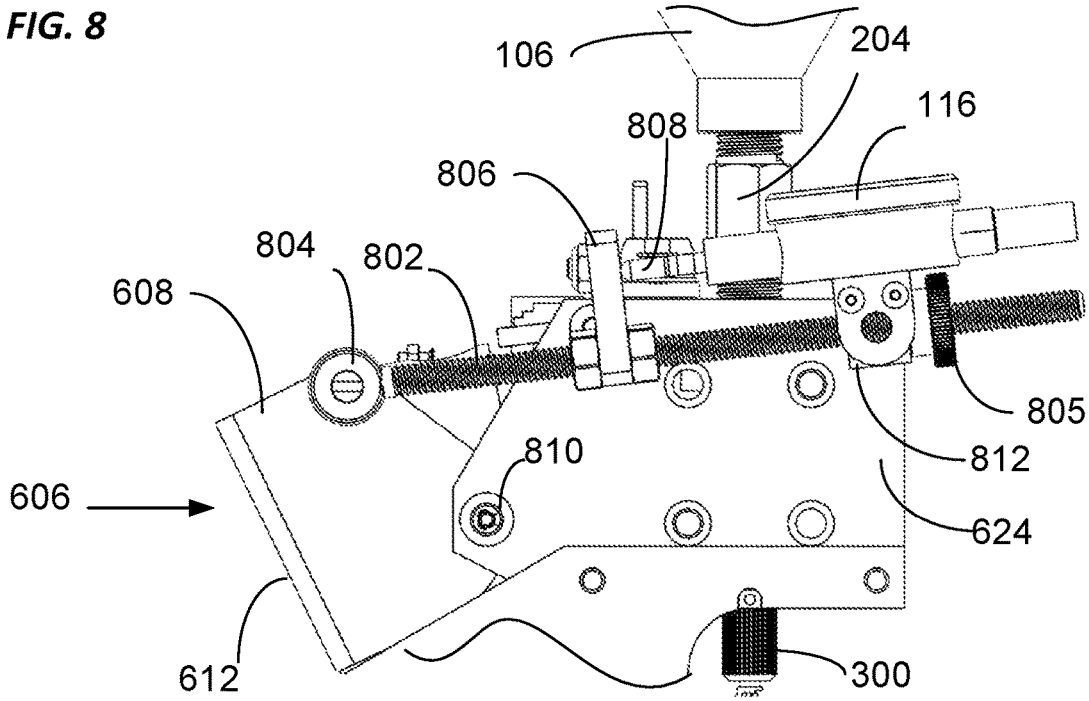
FIG. 8 is a partial side view of the fluid pump motor pivot plate and tilt adjustment screw.

Referring to FIG. 8, the manner of setting the flow rate will now be explained. In FIG. 8, pump motor 616 has been omitted for simplicity. Pivot shaft 810 passes through pivot mount hole 628 of side plate 624, and through a mating hole in side wall 608 of motor pivot plate 606, for helping to pivotally support motor pivot plate 606 from the rear portion of side plate 624. To adjust the flow rate of the fluid pump, a threaded rod 802 has a first end pivotally coupled to the upper portion of side wall 608 of motor pivot plate 606. Adjustment knob 805 is threaded over the opposing end of rod 802. A stop 812 is secured to side plate 624; stop 812 allows rod 802 to pass freely therethrough, but includes a forward-facing wall for being engaged by the rear face of adjustment knob 805. If adjustment knob 805 is rotated clockwise, the distance between first end 804 of rod 802 and knob 805 decreases, causing motor pivot plate 606 to pivot upwardly, to decrease the tilt angle between motor pivot plate 606 and ceramic sleeve 502 (see FIG. 7), and thereby decrease the fluid flow rate. On the other hand, if adjustment knob 805 is rotated counter-clockwise, the distance between first end 804 of rod 802 and knob 805 increases, causing motor pivot plate 606 to pivot downwardly, to increase the tilt angle between motor pivot plate 606 and ceramic sleeve 502 (see FIG. 7), and thereby increase the fluid flow rate.

If desired, a visual indication of the relative flow rate can be provided by a mechanical dial indicator 116, which may be mounted via a bracket secured to stop 812. Dial indicator 116 includes a display gauge which reflects the amount by which compressible stem 808 has been compressed within dial indicator 116. A stop 806 is secured to rod 802 in a desired position by two lock nuts secured on either side of stop 806, and compressible stem 808 of indicator 116 bears against stop 806. When knob 805 is adjusted to change the tilt of motor pivot plate 606, the reading visually displayed by dial indicator 116 also changes. Viscous fluids like cannabis oil may tend to resist suction flow into a pump head, and in these cases, the reciprocation stroke length of pump piston 501, as well as the rotation speed of pump motor 616, can be decreased somewhat to maintain accurate dispensing of such fluid. While such pumps are capable of producing pump outlet pressures of 300 psi, it is preferred that the outlet pressure produced by the pump be maintained closer to approximately 100 psi.

Figure 9:
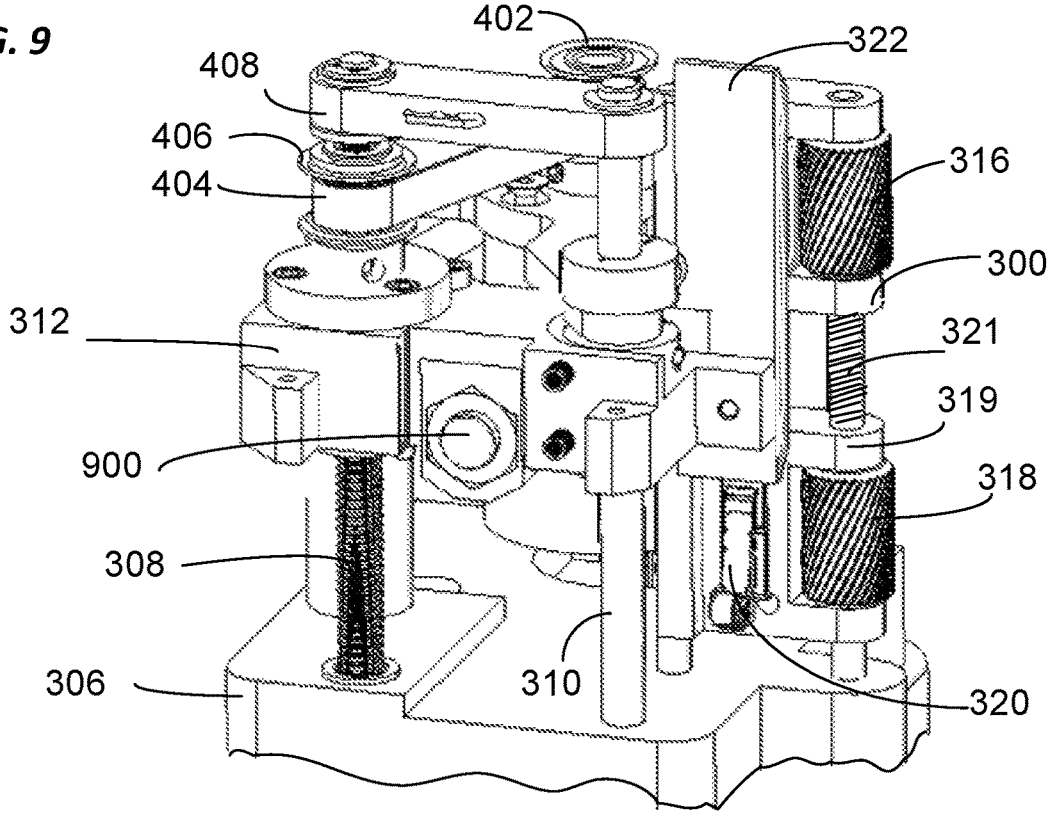
FIG. 9 is a partial perspective view of the dispensing cartridge elevation system with components omitted to reveal a proximity sensor.

FIG. 9 shows portions of the dispensing cartridge elevation system, with some components omitted, to reveal an inductive proximity sensor 900 incorporated within movable cartridge holder 312. Proximity sensor 900 may be of the type sold under the "Contrinex" brand as model AES-AN-3A, and it serves to sense whether or not a dispensing cartridge has already been snapped into cartridge holder 312. When dispensing cartridge 314 (see FIG. 3) is snapped inside cartridge holder 312, it lies within 2 mm. of proximity sensor 900. It will be noted that dispensing cartridge 314 typically includes a metal base, and proximity sensor 900 can sense the presence of such metal base, particularly if cartridge holder 312 is made of plastic components. The output of proximity sensor 900 may be used as a safeguard to ensure that a dispensing cartridge is present before elevating cartridge holder 312 and running the fluid pump.

As mentioned in regard to FIG. 1, filling machine 100 includes a cabinet housing 104. Cabinet housing 104 encloses a number of electrical components including a 24 volt DC electrical power supply, a controller circuit board for controlling the operation of pump motor 616, a temperature control block, several conventional and solid-state relays, an analog programmable logic controller ("PLC") and related expansion I/O modules.

Figure 10:
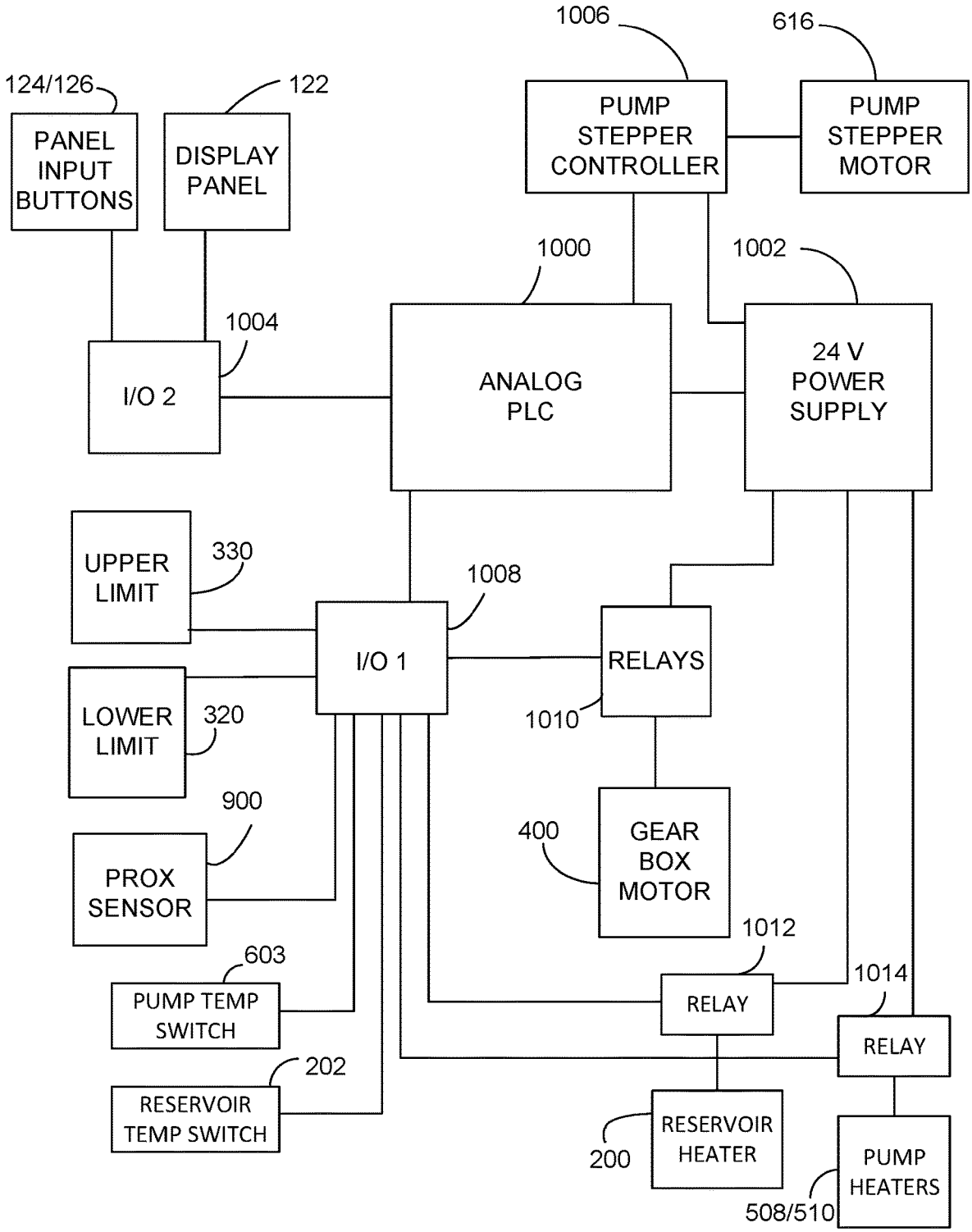
FIG. 10 is a block diagram showing key electrical components for controlling the operation of the filling machine.

FIG. 10 is a block diagram representing electrical components included within filling machine 100. An analog programmable logic controller, or "PLC", 1000 is powered by 24 volt power supply 1002. PLC 1000 may be of the type commercially available under the "CLICK" brand as Model No. CO-02DD1-D. PLC 1000 may be pre-programmed to sequence through a series of control steps, including prompting an operator to input information via display panel 122 and its associated input buttons 124/126. Information to be inputted by the operator might include, for example, the number of revolutions the pump stepper motor should turn to dispense a given quantity of fluid, the fluid capacity of the dispensing cartridges to be filled, the speed and direction of the pump stepper motor, the rotational direction of the gear box motor used to raise and lower the cartridge holder, and/or the delay time to be used between insertion of a dispensing cartridge and the actuation of the elevation of the cartridge holder. Power supply 1002 may be of the type commercially available as the Astrodyne Model No. PMK150S-24 from Astrodyne TDI of Hackettstown, N.J.

While PLC 1000 includes some analog and digital input and output terminals, the capabilities of such I/O terminals can be enhanced and/or expanded by using so-called I/O expansion modules. In FIG. 10, block 1008 is a first such expansion module "I/O 1", and block 1004 is a second such expansion module "I/O 2". I/O 1 block 1008 may be, for example, the type commercially available under the "CLICK" brand as Model Nos. CO-08CDR, adapted to receive low current DC input signals, and to generate higher current output signals for driving relays for switching power to other components, like motors or heaters. I/O 2 block 1004 may be, for example, the type commercially available under the "CLICK" brand as Model Nos. CO-16CDD2, adapted to increase the current-sinking capacity of output signals generated by PLC 1000.

As mentioned in regard to FIG. 1, the front panel of filling machine 100 includes a display panel 122 and user input buttons 124/126. As shown in FIG. 10, I/O 2 block 1004 interfaces PLC 1000 to display panel 122 and user input buttons 124/126, allowing PLC 1000 to display information to the user, and to receive information from the user.

Within FIG. 10, pump stepper controller block 1006 serves as an interface between PLC 1000 and the pump stepper motor 616 (see FIG. 7). Pump stepper controller block 1006 may be of the type commercially available from Fluid Metering, Inc. of Syosset, N.Y. under Model No. IC ST02 Intelligent Stepper Controller. Under the control of the program stored in PLC 1000, controller 1006 properly synchronizes the timing of electrical pulses to pump stepper motor 616 to rotate the pump motor at a desired speed, for a desired length of time, in order to accurately dispense a desired amount of fluid during each fill cycle.

Still referring to FIG. 10, PLC 1000 also controls the operation of gear box motor 400 that raises and lowers the cartridge holder 312. Input signals for controlling gear box motor 400 include lower limit switch 320 (which senses that cartridge holder 312 is at its lowered position for loading/unloading), upper limit switch 330 (which senses that cartridge holder 312 is at its uppermost position for filling), and proximity sensor 900 (which senses that a dispensing cartridge has been loaded into cartridge holder 312). These inputs are routed through I/O 1 block 1008 and passed to PLC 1000. In turn, PLC 1000 provides output signals to I/O 1 block 1008 for controlling relays 1010 which cause gear box motor 400 to rotate either clockwise or counter-clockwise, as appropriate.

Also shown in FIG. 10 are reservoir temperature switch 202 and pump temperature switch 603. These switches signal whether the fluid in reservoir 106, and pump head 114, have reached their respective desired temperatures. The status of such switches is communicated to PLC 1000 by I/O 1 block 1008. In turn, PLC 1000 sends output signals to I/O 1 block 1008 for controlling relays 1012 and 1014, which selectively apply electrical current to reservoir heater 200 and the pump cartridge heaters 508/510.

Figure 11A:
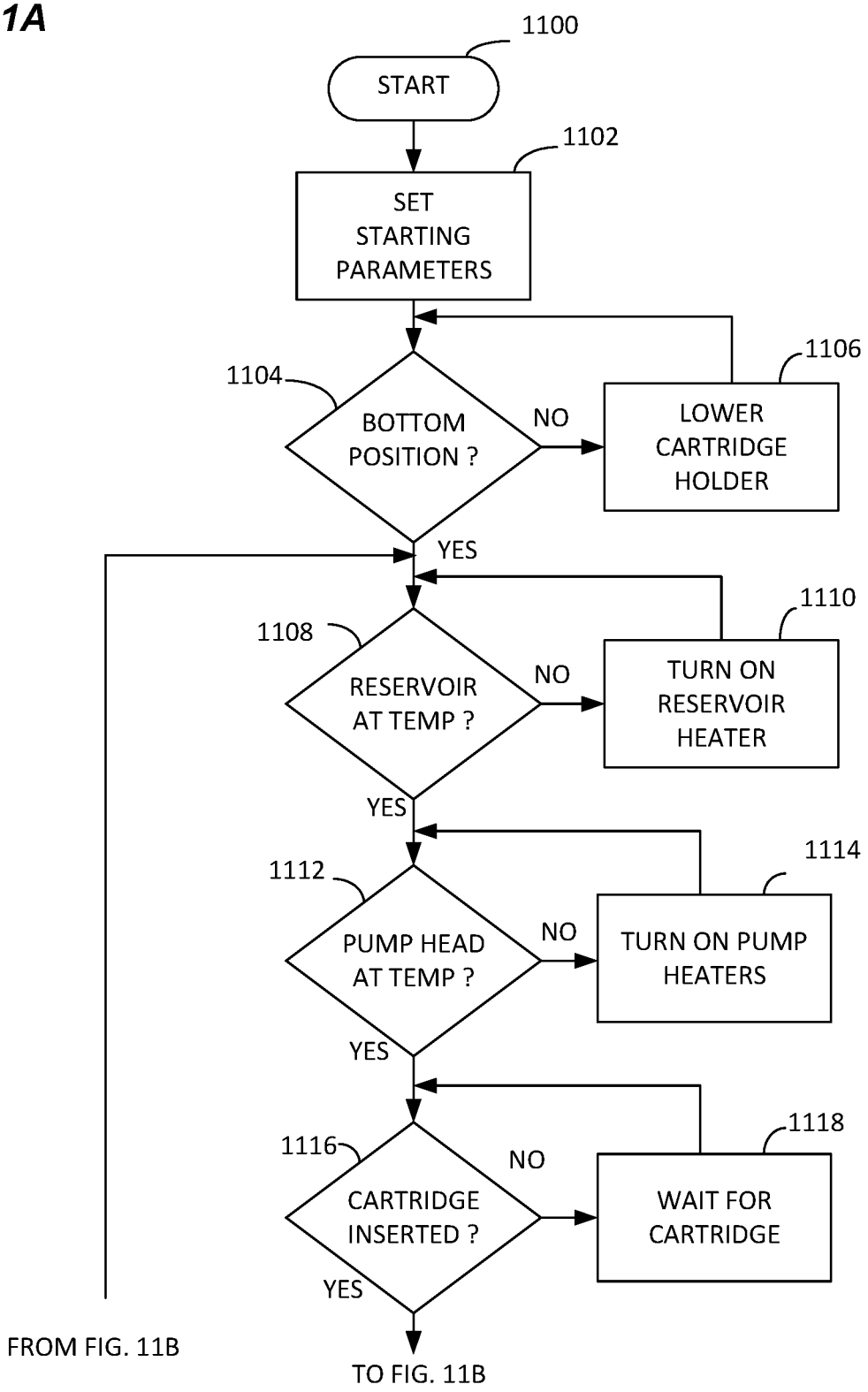
FIGS. 11A and 11B are a flowchart showing the major steps performed by a programmed logic controller for controlling the operation of the filling machine.
Figure 11B:
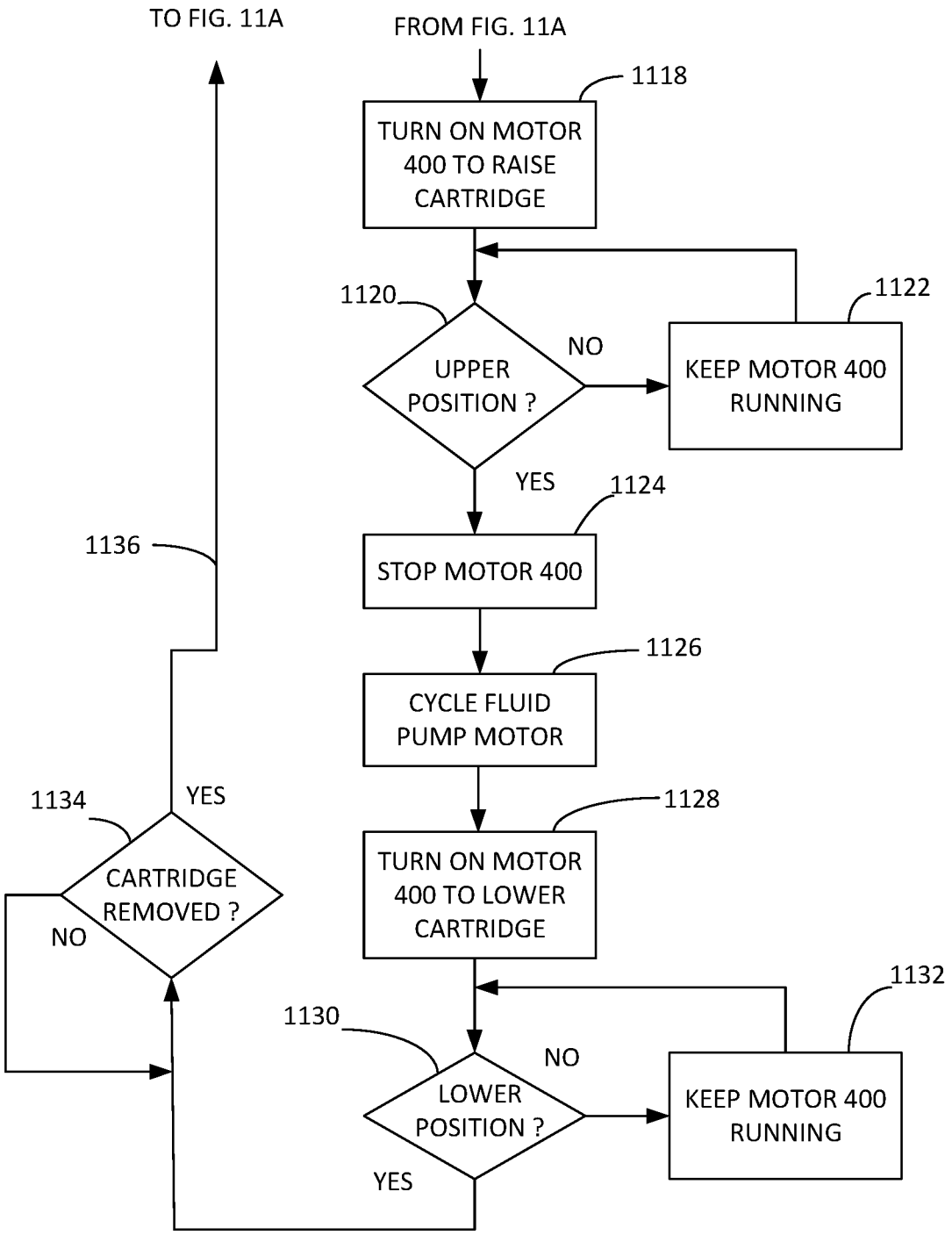

FIGS. 11A and 11B are a flowchart that shows the basic steps performed by PLC 1000 in controlling the operations of filling machine 100. Control starts at the Start block 1100 of FIG. 11A. In block 1102, the machine operator can select starting parameters; these might include the fluid capacity of the dispensing cartridges to be filled, the speed at which the fluid pump should be rotated, the number of revolutions of the pump motor per filling cycle, and the like. At step 1104, a check is made to confirm that the cartridge holder is in its lowermost position; if so, microswitch 320 will signify that it is depressed by switch actuator 322. If microswitch 320 is not already depressed, then step 1106 is performed for actuating gear box motor 400 in the direction that lowers cartridge holder 312. Control passes back to decision box 1104, and eventually, cartridge 312 will return to its lowermost position.

Next, in FIG. 11A, control passes to decision box 1108 to confirm that the fluid in reservoir 106 has reached its desired elevated temperature, which is signified by reservoir temp switch 202 indicating that it has been tripped. If this has not yet happened, PLC 1000 continues to allow current to flow through reservoir heater 200, represented by step 1110, until the desired temperature has been reached. Control then passes to decision box 1112, where a similar check is made to ensure that the pump head assembly 114 has been heated to the desired temperature. If this has not yet happened, PLC 1000 continues to allow current to flow through pump cartridge heaters 508 and 510, represented by step 1114, until the desired temperature has been reached.

Once it has been confirmed that the fluid reservoir and pump head assembly have reached their desired temperatures, control passes to decision box 1116 for detecting whether a dispensing cartridge 314 has been loaded into cartridge holder 312. If so, then proximity sensor 900 will indicate the presence of the dispensing cartridge, and control passes to FIG. 11B. If proximity sensor 900 does not indicate the presence of a dispensing cartridge, then control passes from decision box 1116 to delay box 1118, and back to decision box 1116, while waiting for the operator to insert a dispensing cartridge to be filled. Assuming that proximity sensor 900 does register the presence of a dispensing cartridge, then control passes to step 1118 in FIG. 11B, and PLC 1000 causes gear box motor 400 to rotate in the direction that elevates cartridge holder 312. After gear box motor 400 is turned on, control passes to decision box 1120 to determine whether cartridge holder 312 has reached its fully-elevated position, as signified by upper microswitch 330 being depressed by switch actuator 322. If not, gear box motor 400 continues to run, as indicated by step 1122, until microswitch 330 is depressed.

Once decision box 1120 detects that cartridge holder 312 has been raised to its fully-elevated position, gear box motor 400 is stopped, as indicated by step 1124. The open end of the dispensing cartridge is now closely proximate to the lower end of the fluid injection needle, and the fill cycle can begin. Control passes to step 1126 for cycling the fluid pump motor 616 for allowing the pump to dispense the selected amount of fluid into the open upper end of the dispensing cartridge. The needle heater 304 is left on whenever the filling machine is powered-up, and by the time that the reservoir heater and pump head heaters have reached their proper temperatures, the needle heater 304 will be hot as well.

Once the fluid pump cycle has been completed, control passes to step 1128, and gear box motor 400 is again turned on, but in the opposite rotational direction, to lower cartridge holder 312 back to its bottom position. Decision box 1130 checks to see if cartridge holder 312 has been fully lowered, as signified by depression of lower microswitch 320. If not, motor 400 continues to run, as indicated by step 1132, until cartridge holder 312 reaches its bottom position.

When microswitch 320 signals that cartridge holder 312 has been fully lowered, PLC 100 waits for the operator to remove the filled dispensing cartridge before starting another fill cycle. In FIG. 11B, decision box 1134 checks to confirm that the operator has removed the filled cartridge, as signified by proximity sensor 900 signaling that there is no dispensing cartridge present. If so, control passes along line 1136, back up to FIG. 11A, in preparation for filling the next dispensing cartridge. However, if decision box 1134 detects that the filled dispensing cartridge has not yet been removed, then PLC 1000 simply waits until the operator has removed the filled dispensing cartridge before proceeding.

Those skilled in the art will now appreciate that a filling machine has been described which efficiently and accurately injects cannabis oil, or other an oil-based fluids, into dispensing cartridges while minimizing the likelihood of the oil-based fluid coagulating within the components of the machine. Even though a needle having a relatively narrow bore is used to inject such fluid into such dispensing cartridges, the chances of coagulation and/or clogging of the fluid within the bore of the needle are minimized, thereby minimizing downtime of the machine for maintenance. In addition, by positioning the fluid reservoir directly above the fluid pump, and by positioning the injection needle directly below the fluid pump, a highly compact structure results which avoids hoses and tubes that might also become clogged. The present invention serves to rapidly inject an oil-based fluid into dispensing cartridges while minimizing the likelihood of clogging anywhere between the supply reservoir and the outlet of the injection needle. A minimal number of heaters are used to effectively and continuously heat the fluid being pumped throughout the machine. The described filling machine is very compact, accurate and reliable, relatively simple, comparatively inexpensive, highly automated, and allows a large quantity of dispensing cartridges to be filled in a relatively small amount of time.

While several embodiments are illustrated and/or described herein, it will be appreciated that such disclosed embodiments are merely illustrative of the present invention, and that modifications and variations may be made to such embodiments without departing from the spirit and intended scope of the present invention. Hence, these descriptions and drawings should not be considered in a limiting sense, as it is understood that the present invention is in no way limited to only the embodiments illustrated.

I claim:

1. An apparatus for injecting a fluid into a dispensing cartridge, comprising in combination:

a needle having a shaft extending between a first end adapted to receive fluid and an opposing second end adapted to dispense fluid;

a reservoir adapted to store a fluid;

a fluid pump having an inlet coupled to the reservoir and adapted to receive fluid therefrom, the fluid pump having an outlet adapted to selectively force fluid therefrom, the outlet being coupled to the first end of the needle;

a cartridge holder adapted to releasably hold a dispensing cartridge to be filled; and a needle heater disposed proximate the shaft of the needle and adapted to heat fluid therein for preventing such fluid from coagulating within the needle, wherein the needle heater includes a generally cylindrical bobbin extending around the shaft of the needle, and resistive wire coiled about the bobbin, the resistive wire being adapted to generate heat when an electrical current is conducted thereby.

2. The apparatus of claim 1 wherein the cartridge holder adapted to releasably hold a dispensing cartridge is adapted to alternately move a dispensing cartridge toward and away from the second end of the needle.

3. The apparatus of claim 2 further including a drive motor coupled to the movable cartridge holder, the drive motor being operable to alternately move the movable cartridge holder toward and away from the second end of the needle.

4. The apparatus of claim 3 wherein the fluid pump includes a pump motor, and wherein the pump motor is actuated when the drive motor has moved a dispensing cartridge proximate the second end of the needle.

5. The apparatus of claim 4 further including a control circuit coupled to the drive motor and to the fluid pump for synchronizing the actuation of the pump motor with the operation of the drive motor.

6. The apparatus of claim 1 wherein the fluid pump includes a pump heater adapted to heat fluid within the fluid pump.

7. The apparatus of claim 1 wherein the reservoir includes a reservoir heater for heating fluid within the reservoir.

8. The apparatus of claim 1 wherein the fluid stored by the reservoir is cannabis oil.

9. The apparatus of claim 1 wherein the resistive wire is polymide-insulated nichrome wire.

10. An apparatus for injecting cannabis oil into a dispensing cartridge, comprising in combination:

a reservoir adapted to store cannabis oil, the reservoir including an outlet for delivering stored cannabis oil;

a fluid pump having an inlet coupled to the outlet of the reservoir for receiving cannabis oil therefrom, the fluid pump having an outlet adapted to selectively force cannabis oil therefrom;

a needle having a shaft extending between an inlet end adapted to receive cannabis oil and an opposing outlet end adapted to dispense cannabis oil, the needle being disposed generally directly below the fluid pump, and the inlet end of the needle being connected directly to the outlet of the fluid pump by a valveless connection for receiving cannabis oil directly therefrom; and a cartridge holder adapted to releasably hold a dispensing cartridge to be filled with cannabis oil.

11. The apparatus of claim 10 including a needle heater disposed proximate the shaft of the needle and adapted to heat fluid therein for preventing such fluid from coagulating within the needle.

12. The apparatus of claim 10 wherein the cartridge holder is movable and is adapted to alternately raise a dispensing cartridge toward the outlet end of the needle and lower the dispensing cartridge away from the outlet end of the needle.

13. The apparatus of claim 12 further including a drive motor coupled to the movable cartridge holder, the drive motor being operable to alternately raise the movable cartridge holder toward the outlet end of the needle and lower the movable cartridge holder away from the outlet end of the needle.

14. The apparatus of claim 12 wherein the fluid pump includes a pump motor, and wherein the pump motor is actuated when the movable cartridge holder has raised a dispensing cartridge proximate the outlet end of the needle.

15. The apparatus of claim 14 further including a control circuit coupled to the drive motor and to the fluid pump for synchronizing the actuation of the pump motor with the operation of the drive motor.

16. The apparatus of claim 10 wherein the reservoir is positioned directly above the fluid pump, whereby cannabis oil stored by the reservoir can drain from the lower end of the reservoir directly into the inlet of the fluid pump.

17. The apparatus of claim 10 wherein the fluid pump includes a pump heater adapted to heat fluid within the fluid pump.

18. The apparatus of claim 10 wherein the reservoir includes a reservoir heater for heating fluid within the reservoir.

* * * * *